US010688645B2

(12) United States Patent
Schuster

(10) Patent No.: US 10,688,645 B2
(45) Date of Patent: Jun. 23, 2020

(54) UNIVERSAL SLOTTED WRENCH COMBINATION TOOL

(71) Applicant: GadgetGenius, GP, Bedford, NY (US)

(72) Inventor: Max Schuster, Bedford, NY (US)

(73) Assignee: GadgetGenius GP, Bedford, NY (US)

( * ) Notice: Subject to any disclaimer, the term of this patent is extended or adjusted under 35 U.S.C. 154(b) by 92 days.

(21) Appl. No.: 15/942,998

(22) Filed: Apr. 2, 2018

(65) Prior Publication Data

US 2019/0299385 A1 Oct. 3, 2019

(51) Int. Cl.
*B25F 1/00* (2006.01)
*B25B 13/04* (2006.01)
*B25B 15/02* (2006.01)

(52) U.S. Cl.
CPC ..... *B25F 1/006* (2013.01); *B25B 13/04* (2013.01); *B25B 15/02* (2013.01)

(58) Field of Classification Search
CPC ..... B25F 1/006; B25B 13/04; B25B 15/02
USPC ..... 7/138
See application file for complete search history.

(56) References Cited

U.S. PATENT DOCUMENTS

| | | | | |
|---|---|---|---|---|
| 135,084 | A * | 1/1873 | Cooper | B25B 13/08 81/125.1 |
| 165,671 | A * | 7/1875 | Hagerty | B25B 13/48 7/138 |
| 2,716,367 | A * | 8/1955 | Montgomery | B25B 13/04 81/124.3 |
| 4,442,559 | A * | 4/1984 | Collins | B26B 3/06 30/153 |
| 5,259,281 | A | 11/1993 | Burke | |
| 6,009,581 | A * | 1/2000 | Davis | B25B 13/00 7/105 |
| 6,510,766 | B1 * | 1/2003 | Lin | B25B 15/008 81/177.4 |
| D724,398 | S * | 3/2015 | Streets | D8/17 |
| 2007/0151426 | A1 * | 7/2007 | Kuo | B25B 15/008 81/177.1 |

* cited by examiner

*Primary Examiner* — Hadi Shakeri
(74) *Attorney, Agent, or Firm* — Benjamin E. Carlsen

(57) ABSTRACT

Method and apparatus for fastening rotatable items. A hand tool including two rows of teeth are used to grip fasteners such as lug nuts, screws and bolts. The teeth are located within a slotted region of the handle of the hand tool. Because the slotted region is within the handle, when rotated, both a lateral torque force and a sagittal pressing force is applied to the fastener. This combination of forces makes fasting easier and more efficient.

12 Claims, 5 Drawing Sheets

UNIVERSAL SLOTTED WRENCH COMBINATION TOOL

FIELD OF TECHNOLOGY

This disclosure relates to hand tools and multiple uses and applications thereof in particular hand tools for pushing, pulling, gripping, and/or manipulating objects or articles by a user.

BACKGROUND OF THE DISCLOSURE

Hand tools have been used by humans since the Stone Age. All such tools harness human muscle power to perform increased work by selectively focusing and thereby magnifying applied leverage, torque, friction, pressure, and/or tensile and compressive forces. While the earliest tools were constructed from stone and wood, their material components have evolved to include others such as metals, plastics, ceramics and even exotic materials such as advanced alloys, nano-materials, trace doped materials, and composites.

Despite industrialization and the antiquity of hand tools, there continues to exist a serious need for improved hand tools. This need especially arises in work environments not suited for or not yet converted to automation such as in offshore oil rigs, handling electrical power equipment, or when conducting manufacturing and maintenance operations. In many cases, prior art hand tools provide inadequate or sub-optimally directed focus resulting in less than desired work output. As a result, there is clear utility in, and benefit from, novel hand tools and methods of their use.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

For the purposes of this disclosure, like reference numerals in the figures shall refer to like features unless otherwise indicated. The drawings are only an exemplification of the principles of the invention and are not intended to limit the disclosure to the particular embodiments illustrated.

BRIEF SUMMARY

Figure 1A:
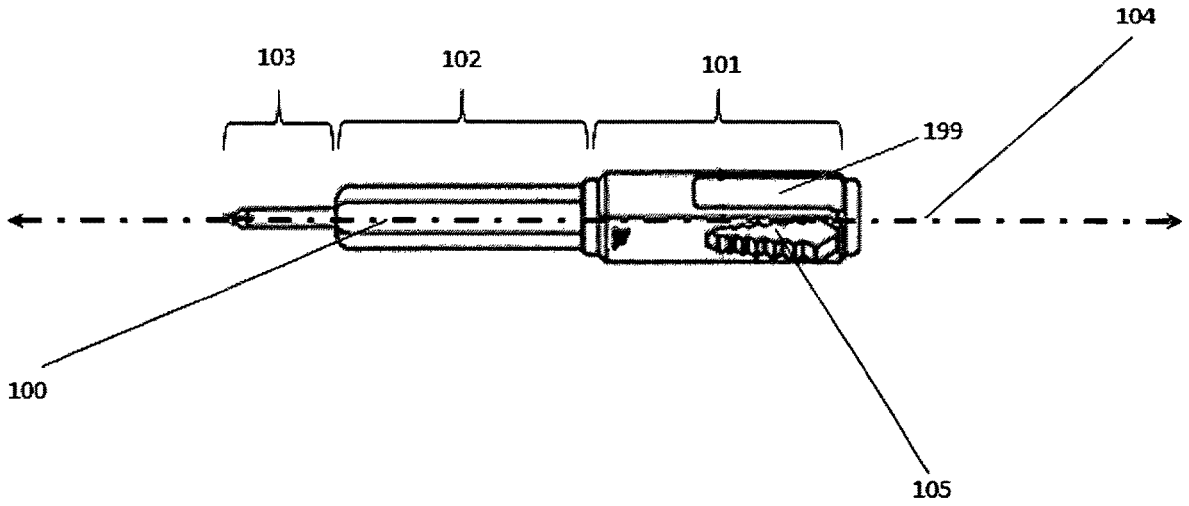
FIG. 1 is a first drawing illustrating a lateral view of a slotted tool.

To satisfy the long-felt needs and unsolved difficulties identified above, at least one embodiment may be directed toward a tool. The tool comprises a handle, an implement, and a slotted region. The slotted region is defined by at least two walls and a palate. Each of the two walls comprise a row of teeth, each row includes at least two teeth. The teeth of each row are arrayed according to a path. The paths are non-perpendicular to each other. The palate is an at least partially solid mass engaged to each of the walls.

The tool may be one item selected from the group consisting of a screwdriver, hammer, claw hammer, tape measure, knife, utility knife, boxcutter knife, chisel, lever, bevel, wrench, pliers, saw, square, mallet, plane, clamp, shovel, spade, pick, axe, drill, and any combination thereof.

The palate may comprise a surface. At least a portion of the surface may be smooth or patterned. The pattern may be one item selected from the group consisting of having ribbing, corrugation, undulation, dimpling, divots, regularly repeating surface interruptions, irregularly repeating surface interruptions, and any combination thereof.

At least one portion of the palate may have a different frictional coefficient than at least one other portion of the palate.

The slotted region may be embedded within the handle.

Each of the rows may extend from closer to implement ends to farther from implement ends, the closer to the implement ends being closer to each other than the farther from the implement ends are to each other.

The slotted region may have a depth. The handle may have a cross-sectional diameter. The ratio between the depth and cross-sectional diameter may be within the range of 1:20 and 20:1.

At least one tooth may have a substantially triangular cross-section. The path may be substantially linear. Each triangular cross-section may comprise three sides, a first side defined by a line which extends between two troughs and a second side and a third side. Both the second side and the third side may extend from one trough and may join at a peak. The angle formed between the base side and one or more of the second side and the third side may be within the range of between 5° and 17°.

The palate may be sloped. The slope may be an angle of between 5° and 90°.

The ratio of the distance between the troughs of a tooth and the shortest distance between the first side of the tooth and the peak of the tooth may be within the range of between 20:1 and 1:20.

The handle may further comprise an outer layer constructed out of a material forming a greater frictional interaction with a human hand than the material the handle is constructed out of. The material may be one item selected from the group consisting of rubber, plastic, foam rubber, vinyl, leather, suede, sponge, buffed foam, silicone rubber, suction cups, synthetic rubber, acrylonitrile butadiene rubber, styrene-butadiene rubber, thermoplastic, latex, acrylic, nylon, Teflon, polycarbonate, and any combination thereof.

The tool may further comprise a tang positioned between the handle and the implement.

At least one of the handle or implement may be constructed out of one material selected from the group consisting of metal, plastic, brass, bronze, steel, iron, copper, tin, nickel, tungsten, cobalt, aluminum, titanium, metal alloys, cast alloy, ceramic, wrought iron, cast iron, cemented carbides, sintered material, borazon, sialon, and any combination thereof.

At least one embodiment may be directed toward a method of fastening. The method may comprise contacting a target item with teeth and a palate of a slotted tool, imparting onto the target item a torque force from the slotted tool; and imparting onto the target item a sagittal force from the slotted tool.

The slotted tool may comprise a handle, an implement, and a slotted region. The slotted region is defined by at least two walls and a palate. Each of the two walls comprise a row of teeth, each row includes at least two teeth. The teeth of each row are arrayed according to a path. The paths are non-perpendicular to each other. The palate is an at least partially solid mass engaged to each of the walls.

The art described in this section is not intended to constitute an admission that any patent, publication or other information referred to herein is "Prior Art" with respect to this invention, unless specifically designated as such. In addition, this section should not be construed to mean that a search has been made or that no other pertinent information as defined in 37 CFR § 1.56(a) exists.

DETAILED DESCRIPTION OF THE DISCLOSURE

Definitions

The following definitions are provided to determine how terms used in this application, and in particular in the claims, are to be construed. The organization of the definitions is for convenience only and is not intended to limit any of the definitions to any particular category.

"Degree" means a measurement of a plane angle, defined so that a full rotation is 360 degrees, it is denoted by ° (the degree symbol).

"Distal" means extending along an axis in the direction running from the implement towards the handle.

"Dimple" means a roughly cylindrical and/or semispherical protrusion extending out of something.

"Divot" means a roughly cylindrical and/or semispherical indentation extending into something.

"Handle" means a region of a tool ergonomically constructed and arranged to be better gripped by a human hand than any other region of the tool. Better gripping may be accomplished by optimizing the circumference or size of the handle, shaping the handle to conform to the contours of a human hand, and/or adjusting physical properties, including but not limited to the frictional coefficient or heat conductivity, to be more compatible with a human hand than other regions of the tool.

"Implement" means a portion of a tool constructed and arranged to contact material external to the tool and to better perform the intended work function on the external material than any other portion of the tool. The implement of a screwdriver is the blade which includes the tip. The implement of a wrench is the pseudo-crescent defined by its jaws and seat. The implement of a ratchet is a socket constructed and arranged to insertably and removably receive a screw head, bolt head, socket, or the like.

"Proximal" means extending along an axis in the direction running from the handle towards the implement.

"Sagittal" means extending along an axis substantially perpendicular to the distal-proximal axis and along the direction of a pressing force applied by a hand pressing down on the handle of the tool.

"Tang" means a region of a tool spanning between the handle and at least a portion of the implement. The Tang may include more than one distinctly definable regions which many include different dimensions and/or may be constructed out of dissimilar materials. For purposes of this application, the Tang does not include tool components or parts which are hafted within one or both of the handle or the implement. The Tang does include portions of the body which include the handle or implement, and which are hefted within a body forming a portion of the Tang.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is described or defined within the reference *Ergonomics and Safety in Hand Tool Design* by Charles A. Cacha, (1999), (Published by CRC Press), this description or definition shall control how the term is defined in the claims.

EMBODIMENTS

As illustrated in FIG. 1, a hand tool (100) may include a handle (101), a tang (102), and an implement (103). Along at least one dimension, the handle (101) extends linearly along a first axis (104). Orthogonal to the first axis (104) is a slotted region (105). While the specific tool (100) shown in FIG. 1 is a screwdriver, it is understood that other tools encompassed by the invention include but are not limited to a hammer, claw hammer, tape measure, knife, utility knife, boxcutter knife, chisel, lever, bevel, wrench, pliers, saw, square, mallet, plane, clamp, shovel, spade, pick, axe, drill, and any combination thereof.

Figure 2:
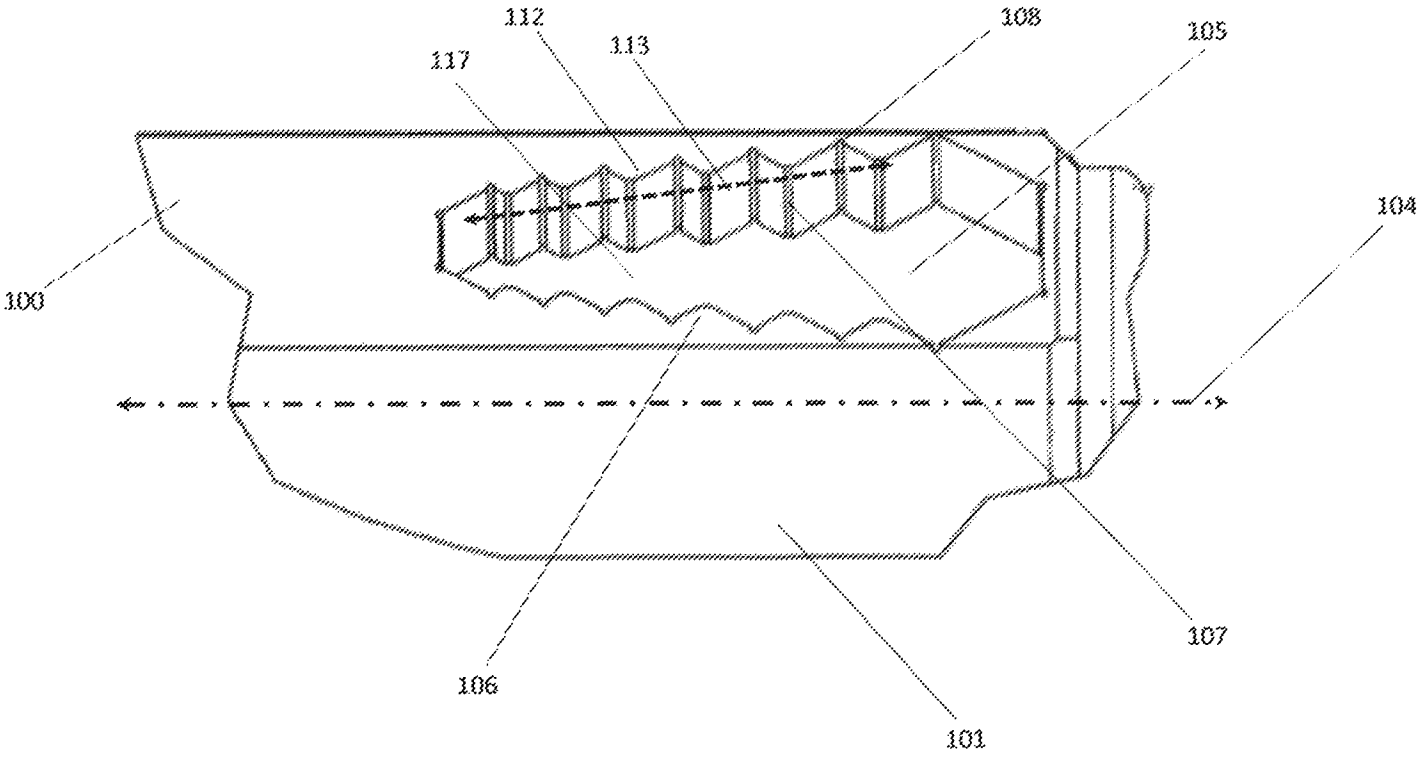
FIG. 2 is a second drawing illustrating a magnified view of a portion of a slotted tool.
Figure 3:
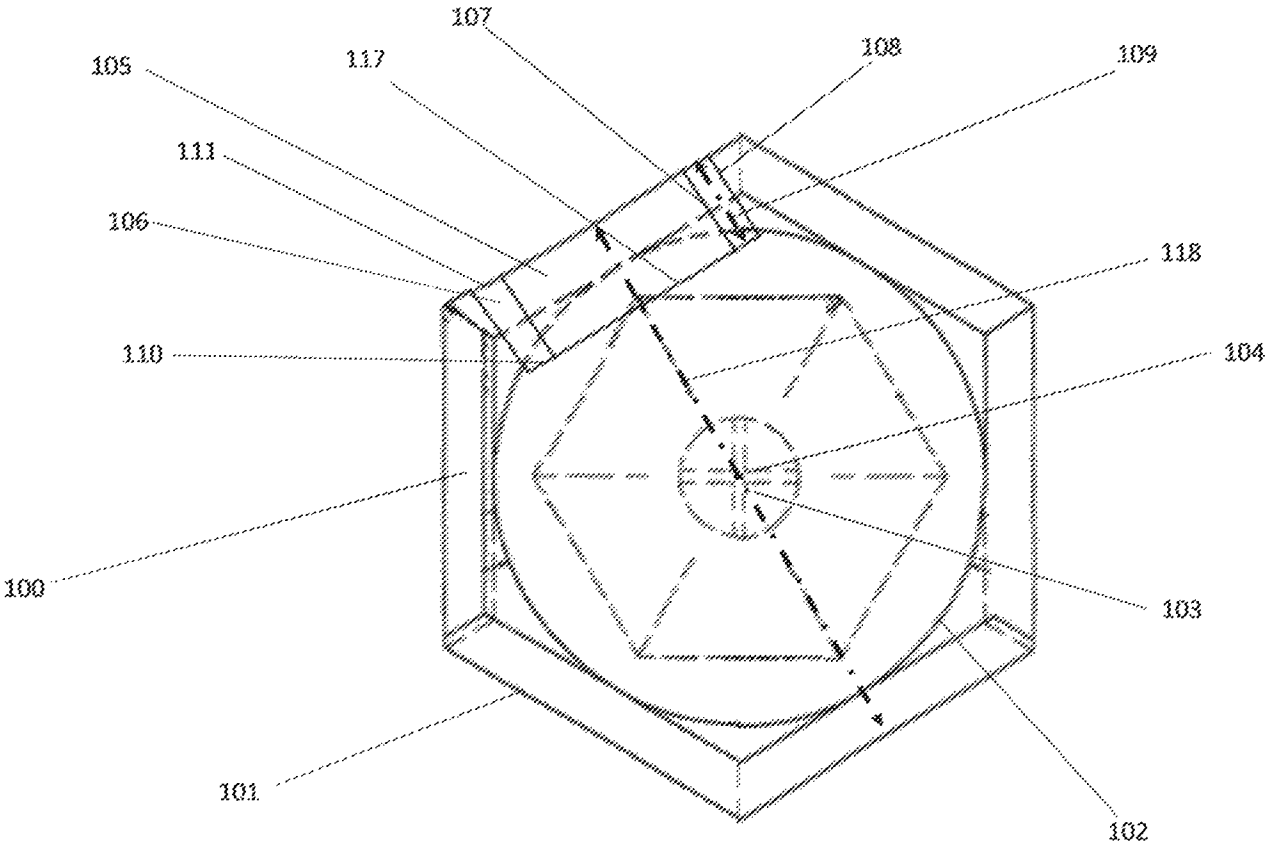
FIG. 3 is a third drawing illustrating a head on cut-away view of a slotted tool.

While the specific slotted region (105) shown in FIG. 1 is recessed within and is defined by the handle (101), the slotted region (105) may also protrude in part or in full exterior to the handle (101). As shown in greater detail in FIG. 2, the slotted region (105) comprises at least two rows (112), each of which comprises a plurality of teeth (106). Each tooth (106) includes a tooth peak (107) and two tooth troughs (108). (Adjacent teeth share common troughs). FIG. 3 shows that each tooth (106) has a dorsal thickness (109) which extends from the bottom of the slotted region (110) to the top of the slotted region (111). Different teeth (106) may have different dorsal thicknesses (109). Different portions of the teeth (106) may have different dorsal thicknesses (109). Each tooth (106) may be of the same size or may have different sizes. Each tooth (106) may share the same peak-trough length or may differ. Similarly, each tooth (106) may be symmetrical or may have different peak-trough lengths along its distal peak-trough length and its proximal peak-trough length.

Extending between the at least two rows of teeth is a palate (117). Some or all of either or both of the palate (117) and/or the dorsal thickness (109) of one or more teeth (106) may be substantially smooth, may have a surface pattern including but not limited to ribbing corrugation, undulation, dimpling, divots, and/or any repeating or irregular interruption of a smooth surface. The surface pattern may result in an increased or decreased frictional coefficient between the palate (117) and/or the teeth (106) and the head of the target item.

Figure 4:
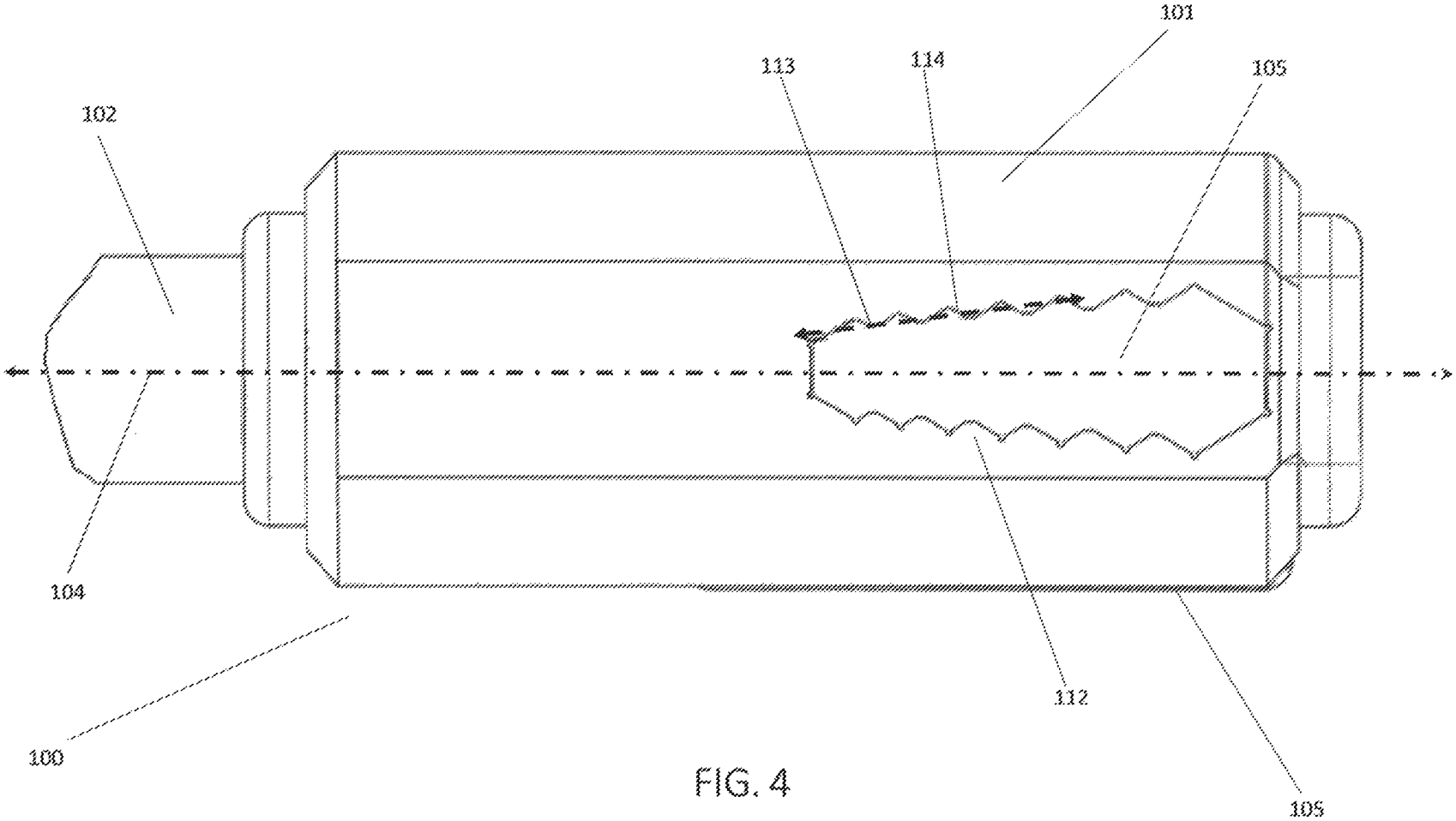
FIG. 4 is a fourth drawing illustrating a lateral view of a portion of a slotted tool.

Each of the at least two rows (112) of teeth (106) extends along a path (113). The path (113) defines the sequential series of midpoints (114) between each peak (107) and trough (108) of each tooth (106) in the row (112). While FIG. 4 illustrates the paths (113) as linear, some or all of the paths (113) may also be arranged according to other patterns including but not limited to a curved, wavy, sinusoidal, and/or irregular patterns. The paths (113) of the at least two rows (112) are not parallel to each other. In at least one embodiment, a more distal tooth (106) of both of the rows (112) are closer to each other than a more proximal tooth of the same row is to a more proximal tooth of the other row (106). In at least one embodiment, a more proximal tooth (106) of both of the rows (112) are closer to each other than a more distal tooth of the same row is to a more distal tooth of the other row (106). As a result, at least a portion of the slotted region (105) is wider than another portion of the slotted region (105).

Figure 5:
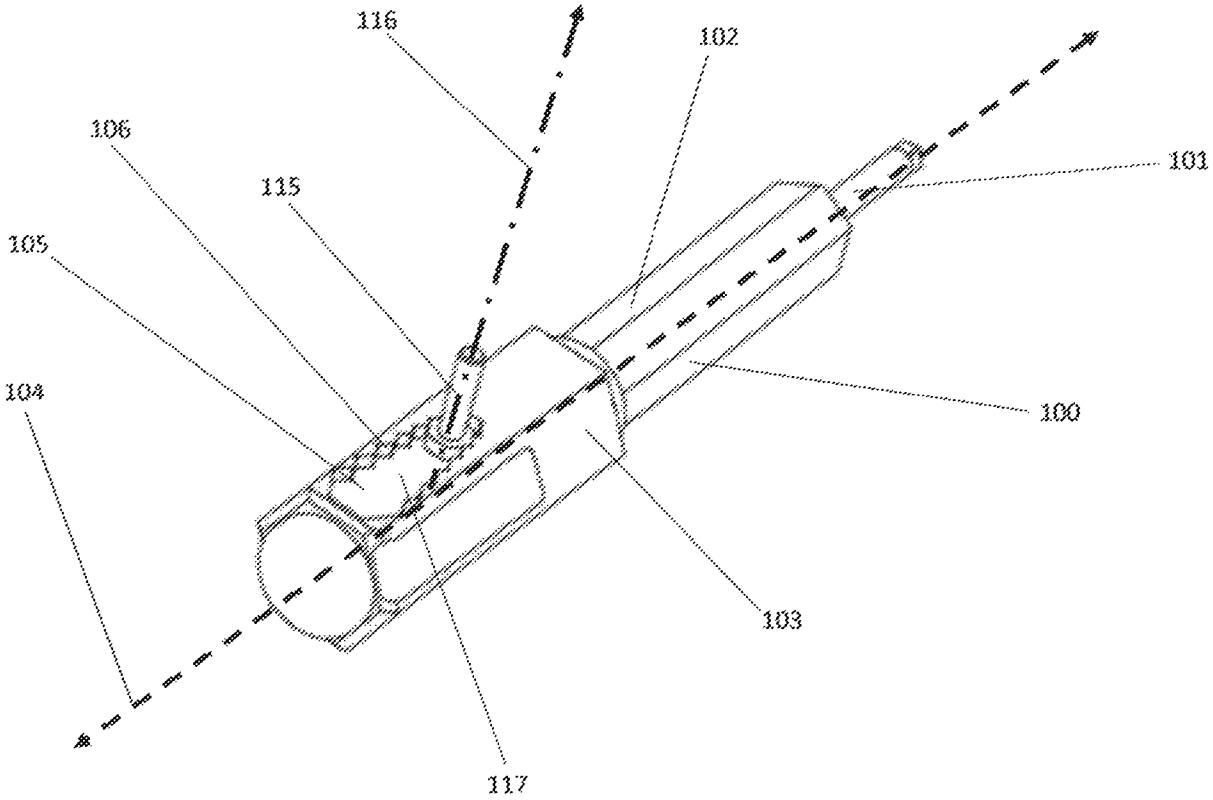
FIG. 5 is a fifth drawing illustrating a perspective view of a slotted tool.

As illustrated in FIG. 5, in an embodiment, the teeth (106) of the slotted region (105) are constructed and arranged to grip a target item (115). Representative target items (115) include but are not limited to screws, bolts, and/or ratchet sockets. Because at least some of the teeth (106) are arrayed between the wider and narrower portions of the slotted region (105), a wide variety of target items (115) can be easily positioned and firmly braced with in the slotted region (105).

In an embodiment, the slotted region may be used to rotate a target item. The head of the target item may be positioned adjacent to the palate between teeth peaks which are displaced from each other by a distance greater than the width of the target item head. The target item head may then be repositioned between the teeth until it is lodged between teeth having a displacement form each other equal to or less than the width of the target item head. In this manner, the head of the target item (115) becomes firmly braced with in the slotted region (105) between teeth of at least two rows. Once so braced, if the handle (101) is rotated, the target item (115) will be rotated as well. In an embodiment, the target item (115) impacts the palate (117) prior to becoming braced by the teeth (106). In an embodiment, target item (115) does not impact the palate (117) prior to becoming braced by the teeth (106).

In an embodiment, the frictional coefficient that results at the interface between the palate (117) and the head of the target (115) item may vary to facilitate optimal positioning of the target item. In an embodiment, the frictional coefficient is higher at a more distal location of the palate than at a more proximal location of the palate. In an embodiment, the frictional coefficient is higher at a more proximal location of the palate than at a more distal location of the palate. In an embodiment, the frictional coefficient is higher at a location of the palate with teeth peaks of the opposite rows having a wider displacement than at a location of the palate with teeth peaks of the opposite rows having a narrower displacement. In an embodiment, the frictional coefficient is lower at a location of the palate with teeth peaks of the opposite rows having a wider displacement than at a location of the palate with teeth peaks of the opposite rows having a narrower displacement. The different frictional coefficients may result from different surface feature or gripping materials present at the different palate locations.

The presence of the slotted region (105) within or protruding from the handle (102) of the tool (101) provides the tool with a number of unexpected results. This can be best appreciated by comparison with the artifact described in U.S. Pat. No. 5,259,281 (hereinafter "Burke"). Burke describes an artifact having jaws with teeth and depressions mounted on a side of an opening which enables torque to be applied to a target item. Unlike with the invention, Burke's opening extends entirely through the mass of the artifact and has two distinct ends. (Burke, Col. 7 lines 16-25). As a result of this geometry, Burke's tool relies entirely upon lateral force from the sidewalls to apply torque to the target item. (Burke, Col. 6 lines 58-65).

In contrast to Burke, because of the presence of the mass of the handle (101) is located immediately orthogonal to the slotted region (105), when the tool is used, an additional sagittal directed force vector (116) is applied to the target item via the palate (117). When the hand tool (100) is gripped by a hand, because the hand's location is sagittal to the target item (115), the hand applies a sagittal directed force vector (116). This sagittal directed force vector (116) impacts the target item in addition to the lateral force vector applied by the teeth (106) of the slotted region (105).

Also, Burke's artifact's opening has a smooth sidewall along with a toothed sidewall. (Burke, Col. 7 lines 65-68). In contrast, the invention relies upon two rows of teeth on both sides of the slotted region (105). Burke's design is to facilitate disengaging and reengaging the target item to cause a ratchet-type effect on the target item (Burke, Col. 8 lines 9-25) and to avoid a biting effect on the target item. (Burke, Col. 6 lines 60-62). This differs markedly from the invention which does impose a dual toothed row "bite" and uses a sagittal directed force vector (116) instead of Burke's ratchet-type effect.

Without being limited by a particular theory or design of the invention or of the scope afforded in construing the claims, it is believed that the relationship between the peak-trough distance, the path angle, the peak-trough angle, and the slope of the palate affect the balance of forces applied to a target item. As a result, many differing configurations of these component parts are contemplated by the inventive concept.

In an embodiment, at least a portion of the slotted region (105) is recessed within the handle. The portion of the slotted region (105) present within the extrapolated boundaries of what would have been the handle if the slotted region (105) were absent has a depth. The depth extends from a point on a plane extending between the outermost walls of the slotted region (105) to a point along the palate where both points are along an axis extending to and perpendicular to the linear axis of the tool (104). Different portions of the slotted region (105) may have different depths. In an embodiment the ratio between a palate depth (109) and the overall cross-sectional diameter (118) of the handle is between 1:20 and 20:1 and includes but is not limited to ratios of 15:1, 13:1 10:1 8:1 5:1, 2:1, 1:1, 1:2, 1:5, 1:8, 1:10, 1:13, 1:15, and any combination thereof.

In an embodiment, one or both of the peak-trough angles of a tooth (106), relative to an axis extending along a portion of the path (113) which spans linearly between the two troughs (108) of a given tooth (106) ranges between 5° (or more or less) and 175° (or more or less) and includes but is not limited to angle ranges of between 10° and 175°, 20° and 175°, 45° and 175°, 60° and 175°, 90° and 175°, 20° and 155°, 20° and 135°, 20° and 115°, 20° and 100°, 20° and 90, 20° and 750, 45° and 155°, 45° and 135°, 45° and 115°, 45° and 100°, 45° and 75°, 60° and 155°, 60° and 135°, 60° and 115°, 60° and 100°, 60° and 75°, 90° and 135°, 90° and 115°, and 90° and 100°, and any combination thereof.

In an embodiment, at least one the path angle, relative to at least a portion of the linear axis, extends according to an angle within the range of more than or equal to 5° and less than or equal to 90° and includes but is not limited to angle ranges of between 10° and 90°, 20° and 90°, 30° and 900, 50° and 90°, 70° and 90°, 20° and 70°, 30° and 70°, 45° and 70°, and any combination thereof.

In an embodiment, at least a portion of the slope of the palate, relative to at least a portion of the linear axis, extends according to an angle within the range of more than or equal to 5° and less than or equal to 90° and includes but is not limited to angle ranges of between 10° and 90°, 20° and 90°, 30° and 90°, 50° and 90°, 70° and 90°, 20° and 70°, 30° and 70°, 45° and 70°, and any combination thereof.

In an embodiment, the ratio of the distance between the two troughs of a tooth and the distance between a tooth peak and the midpoint between the troughs of that tooth may be within the range of 20:1 and 1:20 and includes but is not limited to ratios of 15:1, 13:1 10:1 8:1 5:1, 2:1, 1:1, 1:2, 1:5, 1:8, 1:10, 1:13, 1:15, and any combination thereof. In an embodiment, the tooth peak itself runs along an axis extending generally sagittal to the proximal-distal axis and different points along the sagittal axis of the tooth peak may have different distances according to any of the above ratios previously mentioned in this paragraph.

As illustrated in FIG. 1, in an embodiment, the handle comprises an outer layer (199) constructed out of a material conducive for gripping by a human hand. Representative gripping materials (for use on the outer layer of the handle as well as on the palate) include but are not limited to rubber, plastic, foam rubber, vinyl, leather, suede, sponge, buffed foam, silicone rubber, suction cups, synthetic rubber, acrylonitrile butadiene rubber, styrene-butadiene rubber, thermoplastic, latex, acrylic, nylon, Teflon, polycarbonate, and any combination thereof.

In an embodiment, any one, some, or all of the handle, tang, and/or implement, extending along any portion of some or all of the distal-proximal axis, and/or any other axis, are constructed in part or in full out of a substantially hard material. Representative hard materials include but are not limited to metals, plastics, brass, bronze, steel, iron, copper, tin, nickel, tungsten, cobalt, aluminum, titanium, metal alloys, cast alloys, ceramics, wrought iron, cast iron, cemented carbides, sintered materials, borazon, sialon, and any combination thereof.

In an embodiment, the tang is constructed and arranged to facilitate grasping by a human hand as well. As illustrated in FIG. 3, both the handle and the tang may share a hexagonal cross-section, shaped for human grasping. By allowing for practical grasping of the tool by a hand, a second hand can be used to apply torque force while the first hand applies both torque and sagittal force to the target item. In an embodiment, the handle has a larger circumferential cross section than the tang. The larger circumferential cross section allows for a larger amount of a user's palm to be positioned sagittal to a target item. By making more of the user's palm sagittal to a target item, a larger sagittal directed lateral force may be applied to the target item.

In an embodiment, the length of the handle relative to the proximal-distal axis is greater or smaller than the length of the tang relative to the proximal-distal axis. In an embodiment, the length of the handle relative to the proximal-distal axis is greater or smaller than the length of the implement relative to the proximal-distal axis. In an embodiment, the length of the tang relative to the proximal-distal axis is greater or smaller than the length of the implement relative to the proximal-distal axis. The ratio of the length relative to the proximal-distal axis of any one of the handle, tang, or implement relative to any one or more of the other two may be within the range of 20:1 and 1:20 and includes but is not limited to ratios of 15:1, 13:1 10:1 8:1 5:1, 2:1, 1:1, 1:2, 1:5, 1:8, 1:10, 1:13, 1:15, and any combination thereof.

In an embodiment, the head of the target item has a shape selected from the group consisting of hexagonal, square, triangular, octagonal, pentagonal, polar (straight line), irregular, circular, semicircular, cylindrical, and any combination thereof. The head may include commonly known screw head configurations including but not limited to slotted, phillips, pozidriv, triangle-recess, square-recess, hex (exterior), hex (interior), multi-tooth, torq-set, tri-wing, spanner, and any combination thereof. Some or all of the teeth and/or one or more protrusions extending from the palate may be constructed and arranged to engage with the particular configuration of the target item head. The bottom of the target area may have a configuration including but not limited to threaded screw, smooth, tapered, and lug-nut shaped.

In an embodiment, the teeth are not pure triangles. This may result from intended design shape of the teeth or may result due to wear and tear. In the place of an exact peak, there may be a blunting or rounded shape extending at the region most distant from a given tooth troughs. In such circumstances, the peak may define any region of the tooth extending from a point whose slope relative to axes of the height and width of the tooth is at least one order of magnitude shallower than a lower point of the tooth.

In an embodiment, adjacent teeth may not share common troughs due to a gap extending between the troughs of teeth. Such gaps may be irregular, may be according to a given pattern, or may be randomly positioned between two or more teeth. The ratio of the width of any one or more teeth and the length of one or more gaps between two or more teeth may be within the range of 5:1 and 1:5 and includes but is not limited to ratios of 4:1, 3:1 2:1 1:1, 1:2, 1:3, 1:4, and any combination thereof.

While this invention may be embodied in many different forms, there are described in detail herein specific preferred embodiments of the invention. The present disclosure is an exemplification of the principles of the invention and is not intended to limit the invention to the particular embodiments illustrated. All patents mentioned herein or mentioned, are incorporated by reference in their entirety. Furthermore, the invention encompasses any possible combination of some or all of the various embodiments described herein and/or incorporated herein. In addition, the invention encompasses any possible combination that also specifically excludes any one or some of the various embodiments described herein and/or incorporated herein.

The above disclosure is intended to be illustrative and not exhaustive. This description will suggest, many variations and alternatives to one of ordinary skill in this art. All the alternatives and variations are intended to be included within the scope of the claims where the terms "comprising," and "including" mean "comprising/including, but not limited to". Those familiar with the art may recognize other equivalents to the specific embodiments described herein which equivalents are also intended to be encompassed by the claims.

Those skilled in the art may recognize other equivalents to the specific embodiment described herein which equivalents are intended to be encompassed by the claims attached hereto.

What is claimed is:

1. A tool comprising:

an ergonomic handle with a hexagonal cross-section, a tang with a hexagonal cross-section shaped for human grasping, and an implement all positioned along a linear axis, and a slotted region;

the slotted region positioned within the handle and defined by at least two walls and a palate, each of the two walls extend orthogonally from the axis and comprise comprising a row of teeth, each row including at least two teeth;

the teeth of each row arrayed according to a path, the paths being non-perpendicular and non-parallel to each other;

the tang positioned between the handle and the implement;

each of the tang, the handle, and the implement have a cross-sectional diameter, wherein the cross sectional diameter of the handle where it adjoins the tang is greater than the cross sectional diameter of the tang where it adjoins the handle;

the palate comprising an at least partially solid mass engaged to each of the walls;

wherein at least one portion of the palate has a different frictional coefficient than at least one other portion of the palate;

wherein the palate is sloped relative to said linear axis with an angle of between 5° to 90°; and wherein the handle further comprises an outer layer constructed out of a material forming a greater frictional interaction with a human hand than a material the handle is constructed out of.

2. The tool of claim 1 wherein the tool is one item selected from the group consisting of a screwdriver, hammer, claw hammer, tape measure, knife, utility knife, boxcutter knife, chisel, lever, bevel, wrench, pliers, saw, square, mallet, plane, clamp, shovel, spade, pick, axe, drill, and any combination thereof.

3. The tool of claim 1 wherein the palate comprises a surface, the at least a portion of the surface is smooth or patterned, the pattern is one item selected from the group consisting of having ribbing, corrugation, undulation, dimpling, divots, regularly repeating surface interruptions, irregularly repeating surface interruptions, and any combination thereof.

4. The tool of claim 1 wherein the slotted region is embedded within the handle.

5. The tool of claim 1 wherein the each of the rows extend from closer to the implement ends to farther from the implement ends, the closer to the implement ends being closer to each other than the farther from the implement ends are to each other.

6. The tool of claim 1 wherein the slotted region has a depth, the handle has a cross-sectional diameter and the ratio between the depth and cross-sectional diameter is within the range of 1:20 and 20:1.

7. The tool of claim 1 wherein at least one tooth has a substantially triangular cross-section.

8. The tool of claim 7 wherein each path is substantially linear, each triangular cross-section comprises three sides, a first side defined by a line which extends between two troughs and a second side and a third side, both the second side and the third side extending from one trough and joining at a peak, the angle formed between the first side and one or more of the second side and the third side being within the range of between 5° and 175°.

9. The tool of claim 8 wherein the ratio of the distance between the troughs of a tooth and the shortest distance between the first side of the tooth and the peak of the tooth is within the range of between 20:1 and 1:20.

10. The tool of claim 1 wherein the material is one item selected from the group consisting of rubber, plastic, foam rubber, vinyl, leather, suede, sponge, buffed foam, silicone rubber, suction cups, synthetic rubber, acrylonitrile butadiene rubber, styrene-butadiene rubber, thermoplastic, latex, acrylic, nylon, Teflon, polycarbonate, and any combination thereof.

11. The tool of claim 1 wherein at least one of the handle or implement is constructed out of one material selected from the group consisting of metal, plastic, brass, bronze, steel, iron, copper, tin, nickel, tungsten, cobalt, aluminum, titanium, metal alloys, cast alloy, ceramic, wrought iron, cast iron, cemented carbides, sintered material, borazon, sialon, and any combination thereof.

12. A method of fastening a target item, the method comprising:

contacting the target item with teeth and a palate of a slotted tool, the slotted tool comprising:

an ergonomic handle with a hexagonal cross-section, a tang with a hexagonal cross-section shaped for human grasping, and an implement all positioned along a linear axis, and a slotted region;

the slotted region positioned within the handle and defined by at least two walls and a palate, each of the two walls extend orthogonally from the axis and comprise a row of teeth, each row including at least two teeth;

the teeth of each row arrayed according to a path, the paths being non-perpendicular and non-parallel to each other;

the tang positioned between the handle and the implement;

each of the tang, the handle, and the implement have a cross-sectional diameter, wherein the cross sectional diameter of the handle where it adjoins the tang is greater than the cross sectional diameter of the tang where it adjoins the handle;

the palate comprising an at least partially solid mass engaged to each of the walls;

wherein at least one portion of the palate has a different frictional coefficient than at least one other portion of the palate;

wherein the palate is sloped relative to said linear axis with an angle of between 5° to 90°; and wherein the handle further comprises an outer layer constructed out of a material forming a greater frictional interaction with a human hand than a material the handle is constructed out of;

imparting onto the target item a torque force directed from the tang from the slotted tool; and imparting onto the target item a sagittal force directed from the handle from the slotted tool.

* * * * *